US009381384B2

(12) United States Patent
Tamayo Insua

(10) Patent No.: US 9,381,384 B2
(45) Date of Patent: Jul. 5, 2016

(54) ELECTROMECHANICAL APPARATUS FOR EVACUATING BUILDINGS IN THE EVENT OF A FIRE

(71) Applicant: Joaquín Tamayo Insua, San Sebastian Guipuzcoa (ES)

(72) Inventor: Joaquín Tamayo Insua, San Sebastian Guipuzcoa (ES)

( * ) Notice: Subject to any disclaimer, the term of this patent is extended or adjusted under 35 U.S.C. 154(b) by 0 days.

(21) Appl. No.: 14/382,651

(22) PCT Filed: Feb. 28, 2013

(86) PCT No.: PCT/ES2013/000064

§ 371 (c)(1),
(2) Date: Sep. 3, 2014

(87) PCT Pub. No.: WO2013/132119

PCT Pub. Date: Sep. 12, 2013

(65) Prior Publication Data

US 2015/0028275 A1 Jan. 29, 2015

(30) Foreign Application Priority Data

Mar. 5, 2012 (ES) ..... 201200265

(51) Int. Cl.
*A62B 1/10* (2006.01)
*A62B 1/08* (2006.01)

(52) U.S. Cl.
CPC .... *A62B 1/08* (2013.01); *A62B 1/10* (2013.01)

(58) Field of Classification Search
CPC ..... A62B 1/10; A62B 1/08
See application file for complete search history.

(56) References Cited

U.S. PATENT DOCUMENTS 4,440,261 A 4/1984 Clark
4,503,933 A * 3/1985 O'Neil ..... A62B 1/08 182/231
4,703,831 A 11/1987 Forrest et al.
4,703,832 A * 11/1987 Fontenot ..... A62B 1/20 182/100
5,067,593 A * 11/1991 Tanaka ..... B66B 1/28 187/350
2006/0054420 A1* 3/2006 Gordon ..... A62B 1/02 187/313
2009/0014242 A1* 1/2009 Tang ..... H04Q 9/00 182/241

(Continued)

FOREIGN PATENT DOCUMENTS

CA 2409261 A1 4/2004
CN 101095970 A 1/2008

(Continued)

OTHER PUBLICATIONS

International Search Report for corresponding International Application No. PCT/ES2013/000064.

*Primary Examiner* — Alvin Chin-Shue
(74) *Attorney, Agent, or Firm* — Egbert Law Offices, PLLC

(57) ABSTRACT

An electromechanical apparatus for evacuating buildings in the event of a fire includes a reel that has, rolled up on it, a mooring cable that longitudinally passes through the inside of a rigid tube, ending in an evacuation harness, where an individual will be secured. The weight of the individual makes it possible to rock the tube and a lever that has a braking disc and which acts on a brake disc that allows, by means of a mechanical transmission system, the braking and/or retention of the reel and consequently the descent of the individual. There is a radio-control unit and a standalone electric and electronic safety system that is activated when the speed of descent of the individual is too great. The apparatus allows evacuation and can be reused, once used. The apparatus carries away, brakes, retains and evacuates the individual making use of the electromechanical apparatus.

4 Claims, 7 Drawing Sheets

(56) References Cited

U.S. PATENT DOCUMENTS

| | | | | |
|---|---|---|---|---|
| 2010/0273597 | A1* | 10/2010 | Wilson, Jr. | A62B 1/10 475/149 |
| 2013/0299281 | A1* | 11/2013 | Lahteenmaki | B66B 5/0037 187/247 |

FOREIGN PATENT DOCUMENTS

| | | | | |
|---|---|---|---|---|
| ES | 2249132 | A1 | 3/2006 | |
| GB | 295976 | A * | 8/1928 | B63B 23/18 |
| JP | 2008188195 | A | 8/2008 | |
| WO | 8203015 | | 9/1982 | |

* cited by examiner

SECTION
AB
AC
55
49
56
47
63
52
64
13
68
59
37
10
15
45
8
14
39
70
61
41
3
4
53
71
12
5
6
66
65
11
7
67
9
40
43
54
58
SECTION
X
SECTION
Y

SECTION B
57
55
56
50
49
60
59
39
69
71
68
8
14
15
2
65
19
47
43
3
4
20
67
5
41
71
48
44
42
46
45
6
7
27
22
24
18
26
23
21
25
38
1
16
17
54
9
72
36
SECTION
Y

ELECTROMECHANICAL APPARATUS FOR EVACUATING BUILDINGS IN THE EVENT OF A FIRE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an electromechanical apparatus intended to evacuate buildings in the event of a fire, thanks to which the people (and animals) are evacuated to safety, lowering them to the ground and away from the danger zone.

2. Description of Related Art Including Information Disclosed Under 37 CFR 1.97 and 37 CFR 1.98.

The Applicant has no knowledge about any backgrounds related to his invention.

BRIEF SUMMARY OF THE INVENTION

The electromechanical apparatus for evacuating buildings in the event of a fire, has a rigid tube or arm, supported on a guide by one of its ends, and fastened by a piston lock by the other, where it ends with a tip. The tube, embraced by a retaining ring, is held at the same time, by two bolts with bushes, located in both holes that have the ears of the swivel mounting. This has an internal bolt that serves as a stopper with the base that supports it, thanks to a curved recess that it has. Along with mixed ball bearings with grease and lid, the rotation and inclination of the tube is achieved. This may also be fixed to avoid the rotation. In this way, the ears they are welded to a main base, and the mixed ball bearings, grease and its lid, lock piston, guide, swivel mounting, its base and bolt are annulled.

The apparatus has a clamping screw, in which a support is threaded that seats a lower braking disc, on which rests a toothed disc brake, and above this, another upper braking disc with support.

This communicates with the tube, by means of a lever attached by a support with a bolt, and having a hole where a screw passes through. This has a nut and lock nut securing washers that rest on a main base.

The apparatus has a support that supports a motor, a gearbox with shaft, a clutch, a pinion with ball bearing, a diversion with encoder and a reel, in addition to two safety plungers with their detectors, and two electromagnets, all with supports.

The apparatus has a mooring cable, which rolled into the reel, passes through longitudinal inside the rigid tube, ending in a bosom where a clip hook is fixed, where an evacuation harness is anchored.

The apparatus has an uninterruptible power supply system, batteries, an electric board, a warning light and a radio-control unit.

In combination with everything described above, the apparatus has a sufficient descent and ascent capacity by the cable; separation, braking, retention and rescue on the ground (evacuation), of the person or people who experience a leap in the dark from a building, in the event of a fire or emergency.

For a better understanding of what is described above, the following tabled is attached:

| No. OF PARTS | DEFINITION | No. OF FIGURES |
|---|---|---|
| 1 | Rigid tube | 2, 3, 5, 6 and 7. |
| 2 | Base of swivel mounting | 2 and 5. |
| 3 | Support of upper braking disc | 1 and 5. |
| 4 | Upper braking disc | 1 and 5. |
| 5 | Brake disc | 1 and 5. |
| 6 | Lower braking disc | 1 and 5. |
| 7 | Support | 1 and 5. |
| 8 | Clamping screw of support | 1 and 5. |
| 9 | Reel | 1 and 5. |
| 10 | Lever holder | 1, 2 and 3. |
| 11 | Bolt of lever holder | 1, 2 and 3. |
| 12 | Fixed Belleville spring | 1. |
| 13 | Movable Belleville spring | 1. |
| 14 | Lever | 1, 2, 3 and 5. |
| 15 | Main base | 1, 2, 3, 4 and 5. |
| 16 | Bolt of right ear | 5. |
| 17 | Bolt of left ear | 2, 3 and 5. |
| 18 | Retaining ring of rigid tube | 2, 3 and 5. |
| 19 | Rigid tube guide | 2 and 5. |
| 20 | Swivel mounting | 2 and 5. |
| 21 | Right ear of swivel mounting | 5. |
| 22 | Left ear of swivel mounting | 2, 3 and 5. |
| 23 | Stopper | 5. |
| 24 | Shaft of stopper roller two | 5. |
| 25 | Shaft of stopper roller three | 5. |
| 26 | Shaft of stopper roller four | 5. |
| 27 | Stopper roller two | 5. |
| 28 | Tip | 2, 3, 6 and 7. |
| 29 | Terminal of left tip | 2 and 3. |
| 30 | Bolt of upper sheave of tip | 2 and 3. |
| 31 | Bolt of lower sheave of tip | 2 and 3. |
| 32 | Lock piston | 7. |
| 33 | Bolt two of tip | 2 and 3. |
| 34 | Bolt three of tip | 2 and 3. |
| 35 | Small sheave of tip | 2 and 3. |
| 36 | Mooring cable | 2, 3, 5 and 6. |
| 37 | Washer (series) | 1. |
| 38 | Rear bush | 2, 3 and 5. |
| 39 | Holder for detectors | 1 and 5. |
| 40 | Diversion | 1 and 4. |
| 41 | Spring one | 1 and 5. |
| 42 | Spring two | 5. |
| 43 | Spring of electromagnet one | 1 and 5. |
| 44 | Spring of electromagnet two | 5. |
| 45 | Case of spring one | 1 and 5. |
| 46 | Case of spring two | 5. |
| 47 | Case of spring of electromagnet one | 1 and 5. |
| 48 | Case of spring of electromagnet two | 5. |
| 49 | Electromagnet one | 1 and 5. |
| 50 | Electromagnet two | 5. |
| 51 | Clutch pinion | 4. |
| 52 | Belleville nut | 1. |
| 53 | Fixed Belleville coupling | 1. |
| 54 | Reel support | 1 and 5. |
| 55 | Support of electric pistons and electromagnets | 1 and 5. |
| 56 | Electric piston one | 1 and 5. |
| 57 | Electric piston two | 5. |
| 58 | Support-Structure | 1 and 4. |

-continued

| No. OF PARTS | DEFINITION | No. OF FIGURES |
|---|---|---|
| 59 | Stopper of the electric piston one | 1 and 5. |
| 60 | Stopper of the electric piston two | 5. |
| 61 | Clutch | 1 and 4. |
| 62 | Clutch shaft | 4. |
| 63 | Gearbox | 1 and 4. |
| 64 | Motor | 1 and 4. |
| 65 | Detector holder | 1 and 5. |
| 66 | Detector one | 1. |
| 67 | Detector two | 1 and 5. |
| 68 | Detector of electric piston one | 1 and 5. |
| 69 | Detector of electric piston two | 5. |
| 70 | Regulator of electric piston detectors | 1 and 5. |
| 71 | Markers | 1 and 5. |
| 72 | Reel shaft | 4 and 5. |
| 73 | Encoder | 4. |
| 74 | Radio-control unit | 6. |
| 75 | Uninterruptible power supply system | 6. |
| 76 | Batteries | 6. |
| 77 | Cabinet of electric board | 6. |
| 78 | Main support of apparatus | 6 and 7. |
| 79 | Warning light | 6. |

Screws, clamps, clips, etc., are not defined, because they have a secondary character.

BRIEF DESCRIPTION OF THE DRAWINGS

For a better understanding of what is described in the present specification, some drawings are attached which, solely by way of example, show a practical case of embodiment of the electromechanical apparatus.

In said drawings, governed by the American international system, the

FIG. 5 is a (right partial) elevation view of the mentioned apparatus; in

FIG. 6 can be seen the assembly of the mentioned apparatus; in

Figure 1:
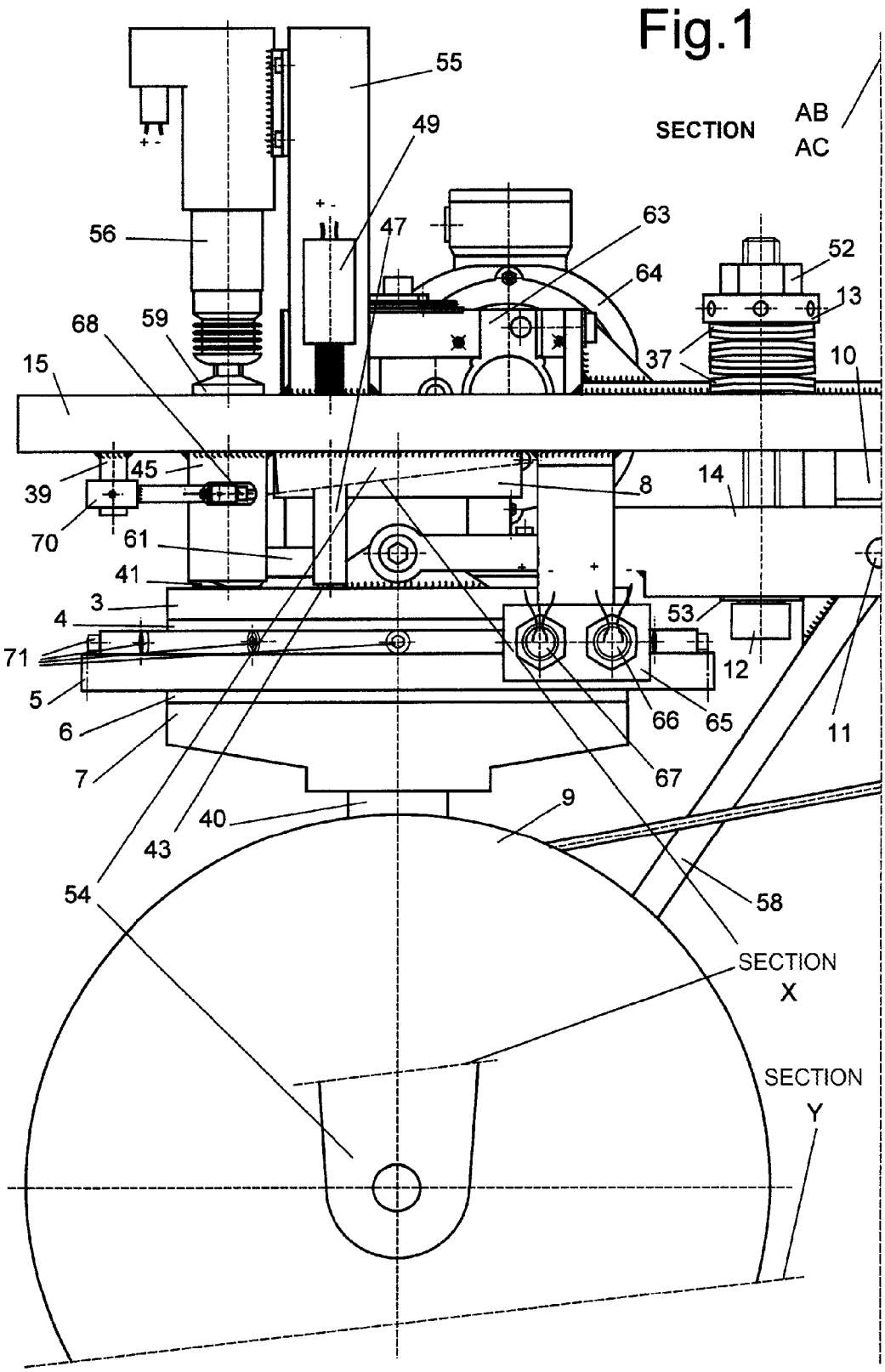
FIG. 1 is a (left partial) view on right side of the electromechanical apparatus.
Figure 2:
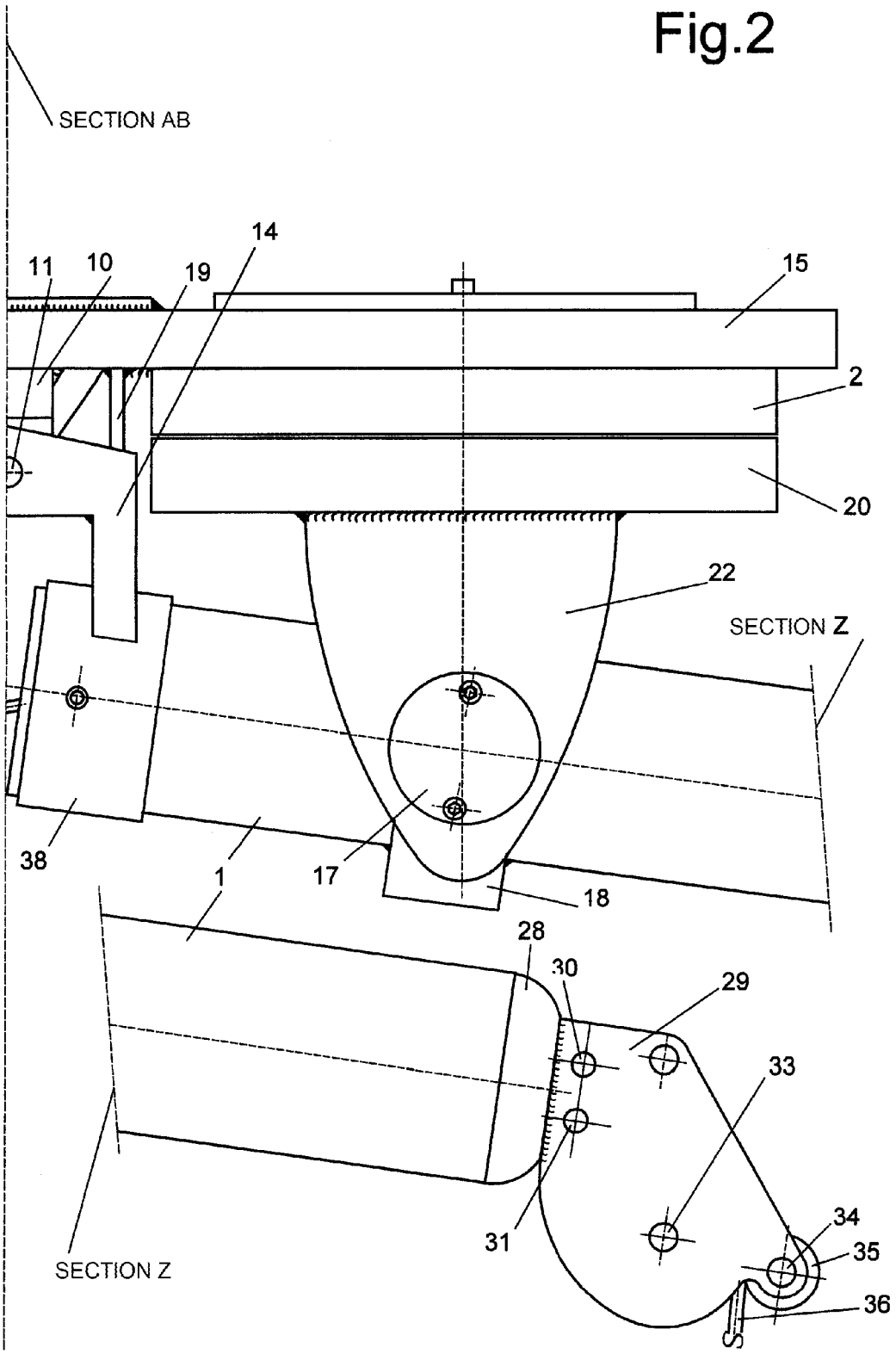
FIG. 2 shows a (right partial) view on right side of the mentioned apparatus.
Figure 3:
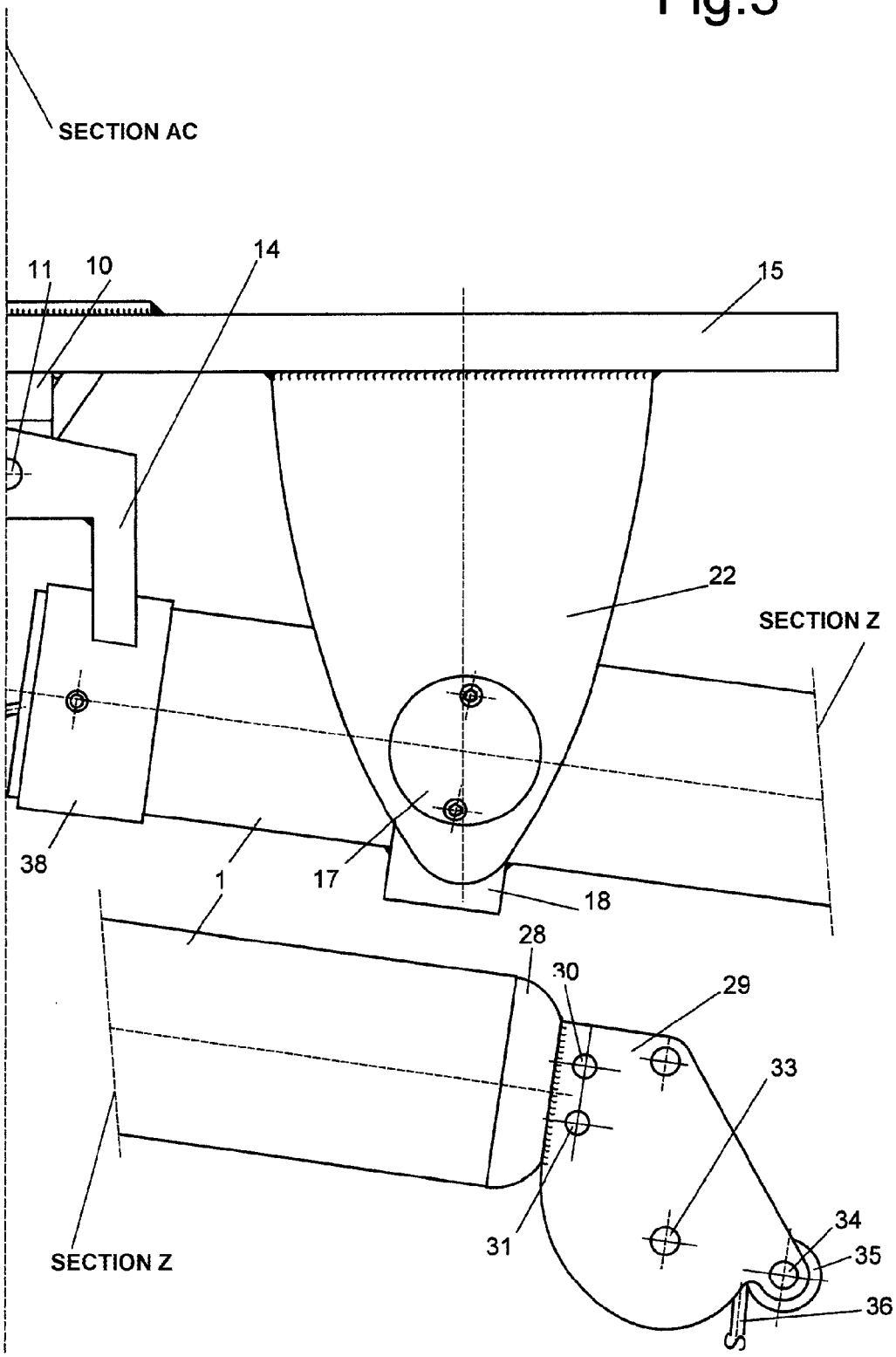
in FIG. 3, maintaining the order of the pages, a (right partial) view on right side of the apparatus in question is distinguished.

The drawings of FIGS. 1, 2, 3, 4 and 5, are cut or sectioned in order to distinguish them, and their matching is done by means of the union of the sections detailed in the following table:

| |
|---|
| FIG. 1 "SECTION AB/AC" . . . joins with FIG. 2 by means of . . . "SECTION AB". |
| FIG. 1 "SECTION AB/AC" . . . joins with FIG. 3 by means of . . . "SECTION AC" |
| FIG. 4 "SECTION B" . . . joins with FIG. 5 by means of . . . "SECTION B" |

DETAILED DESCRIPTION OF THE INVENTION

The electromechanical apparatus involved can be made of a hard, tough material, with minimum deformity in terms of tonnage and expansion, as well as the resistance to high temperatures and impact, either stainless steel or similar. The apparatus is provided with a base (15) supporting, by means of a screw (8), a brake disc (5) and two braking discs (4 and 6) with their supports (3 and 7). It also has a support (58) which holds a motor (64), a gearbox (63), a clutch (61) with its pinion (51), a diversion (40) with its encoder (73) and support (54) that holds a reel (9). This (9) communicates, through a cable (36), with a tube (1) that is attached to the base (15), already mentioned, by ears (21 and 22), or with a swivel mounting (20) with its base (2). A support (55) holds two pistons (56 and 57) and two electromagnets (49 and 50), all with their springs (41, 42, 43 and 44). Held by a holder (10), a lever (14) houses a screw (12) with washers (37). The apparatus is also equipped with an electric board (77), an uninterruptible power supply system (75) with batteries (76), a warning light (79) and a radio-control unit (74).

Above are described well-known aspects of the electromechanical apparatus.

The essential features of the electromechanical apparatus consist of having a swivel mounting (20) (FIGS. 2 and 5), holding a tube (1) (FIGS. 2, 3, 5, 6 and 7) which can also be fixed.

Another remarkable feature of the electromechanical apparatus is that there is a brake disc (5) (FIGS. 1 and 5), in combination with a reel (9) (FIGS. 1 and 5), housing a mooring cable (36) (2, 3, 5 and 6).

Figure 5:
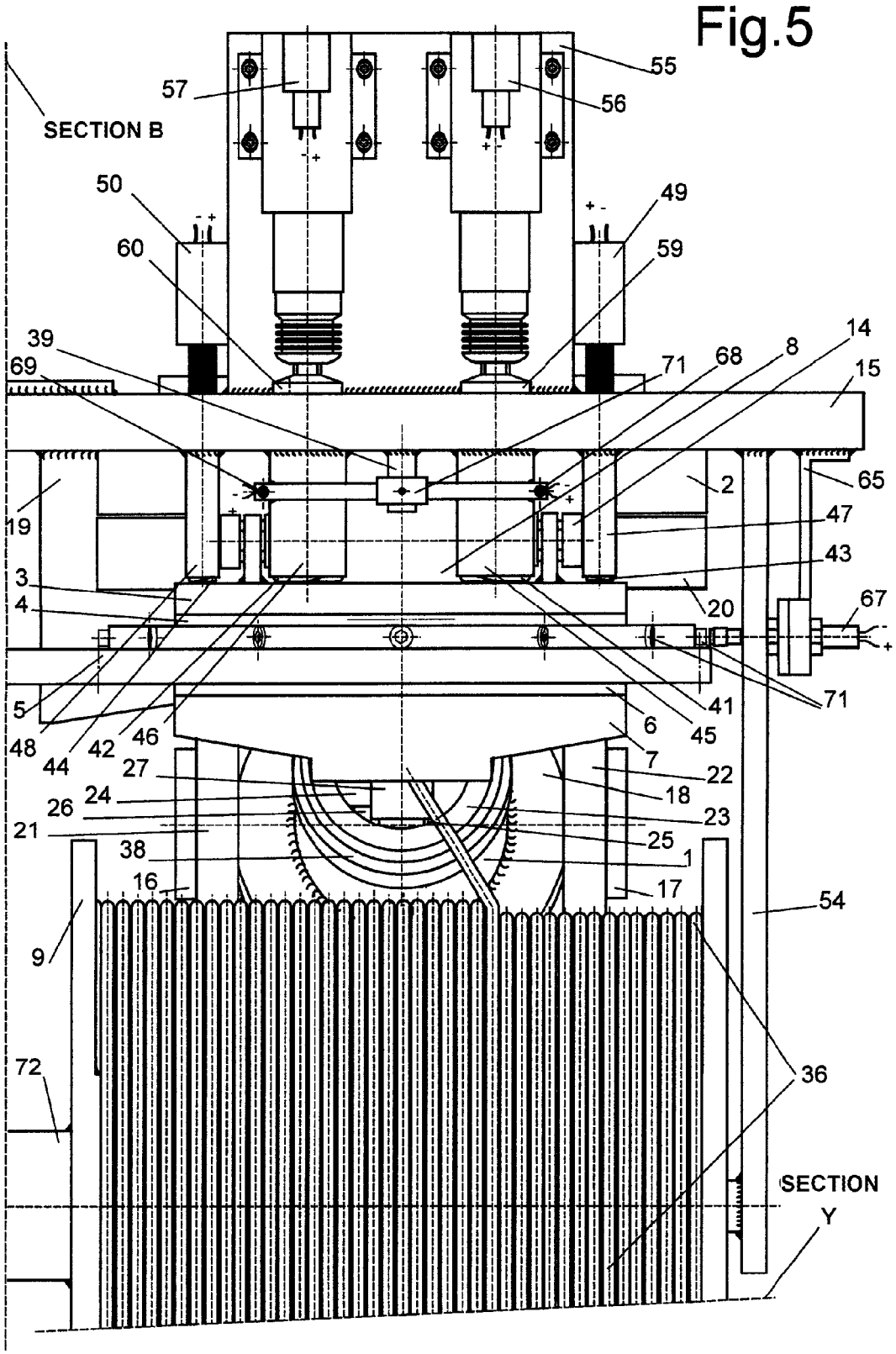

Two electric pistons (56) (FIGS. 1 and 5), (57) (FIG. 5), two electromagnets (49) (FIGS. 1 and 5), (50) (FIG. 5), and a lever (14) (1, 2, 3 and 5) communicate with a brake disc (5) (FIGS. 1 and 5).

Figure 6:
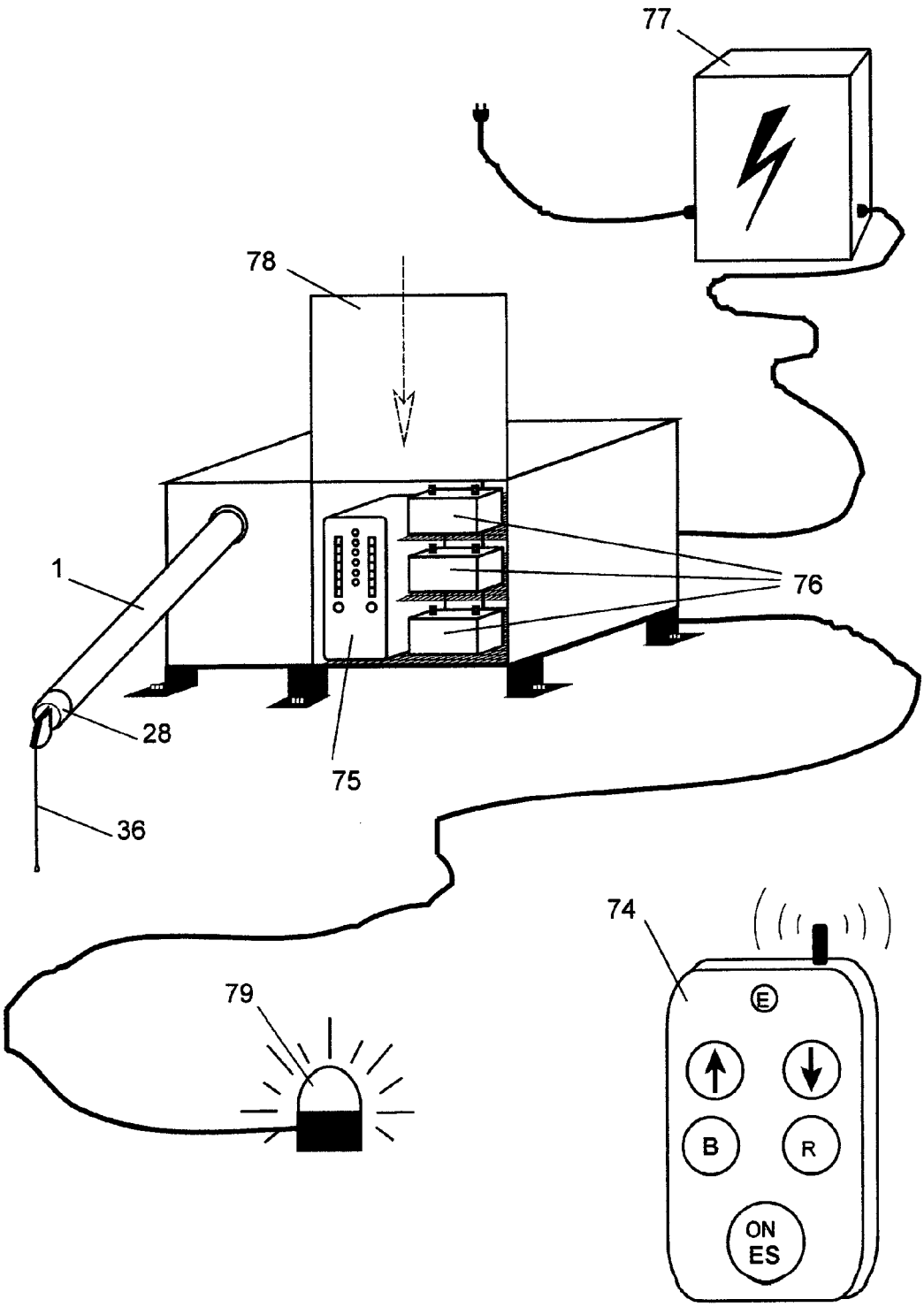
Figure 7:
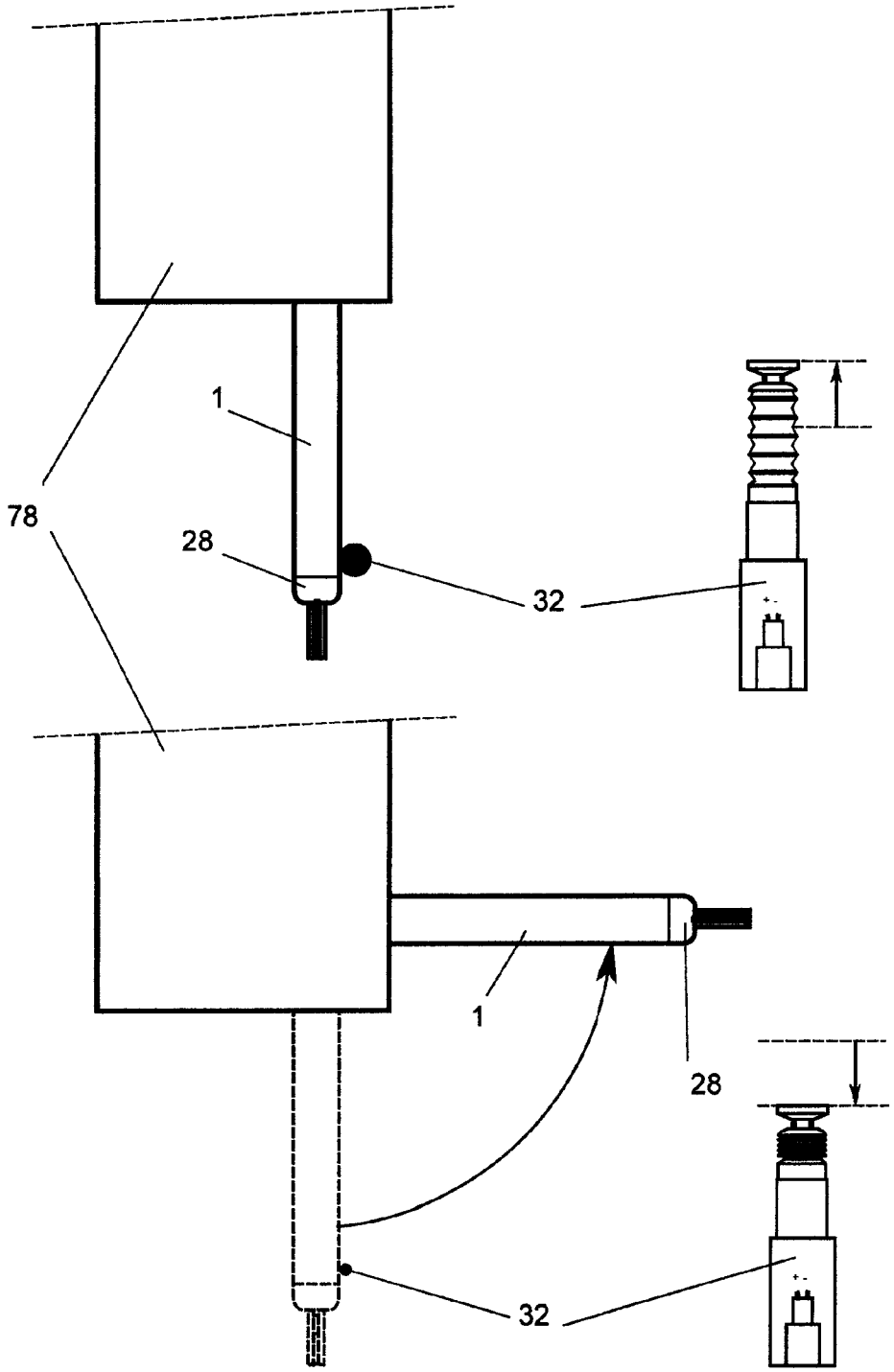
FIG. 7, a (partial double) plan view of the rotation of the rigid tube and another elevation view of the piston lock of electromechanical apparatus, are distinguished.

Other feature of the electromechanical apparatus is that it has a radio-control unit (74) (FIG. 6), in combination with an electric board (77) (FIG. 6), an uninterruptible power supply system (75) (FIG. 6) with batteries (76) (FIG. 6) and a warning light (79) (FIG. 6).

The advantages of the intended apparatus emerge from all described above and the observation of drawings.

First of all, it should be emphasized the mission of a main base (15) (FIGS. 1, 2, 3, 4 and 5) that, welded or screwed to a main support (78) (FIG. 6), is the center piece of the apparatus in question. Welded on the bottom of this, there is a circular base (2) (FIGS. 2 and 5) and a circular swivel mounting (20) (FIGS. 2 and 5) that hangs from the aforementioned base, and passing through the center of both, there is an attachment screw seated by its head in a mixed ball bearing located in a concentric, circular, and upper recess, having said base. There is a mixed ball bearing coupled in a concentric, circular, and bottom recess having the mentioned mounting swivel. The attachment of this to the circular base (2) (FIGS. 2 and 5) is achieved with a nut and lock nut that are threaded on the opposite side of the screw head, already cited.

There is a rigid tube (1) (FIGS. 2, 3, 5, 6 and 7) welded to a retaining ring (18) (FIGS. 2, 3 and 5) where there are two opposite holes with bushes. These, in turn, house two bolts (16) (FIG. 5), (17) (FIGS. 2, 3 and 5), which are inserted through two holes having two semi-oval ears (21) (FIG. 5), (22) (FIGS. 2, 3 and 5), welded parallel to the swivel mounting (20) (FIGS. 2 and 5). The rigid tube (1) (FIGS. 2, 3, 5, 6 and 7), at one of its end, has a rear bush (38) (FIGS. 2, 3 and 5) resting on a guide (19) (FIGS. 2 and 5) when not in use, and at the other end, where there is a tip (28) (FIGS. 2, 3, 6 and 7), is retained by a lock piston (32) (FIG. 7), the mission of which is the retaining of the rigid tube (1) (FIGS. 2, 3, 5, 6 and 7). The rotation of this is carried out from a button having a radio-control unit (74) (FIG. 6), as explained below, and with this action the lock piston (32) (FIG. 7), retracts, and releases the rigid tube (1) (FIGS. 2, 3, 5, 6 and 7) which rotates 90°, by means of an internal bolt that exists between the swivel mounting (20) (FIGS. 2 and 5) and its base (2) (FIGS. 2 and 5). Simultaneously, it tilts and slides on the guide (19) (FIGS. 2 and 5), finally fitting in a lever (14) (FIGS. 1, 2, 3 and 5) that serves as a stopper, and positions it for the use of the apparatus in question.

In combination with all described above, the rotation, inclination, orientation and useable position of the rigid tube (1) (FIGS. 2, 3, 5, 6 and 7) is achieved in order to distance, with respect to a building, the individual(s) who make use of the electromechanical apparatus.

There is a second option in which the rigid tube (1) (FIGS. 2, 3, 5, 6 and 7) is fixed. In this way, it is oriented and in useable position, because the ears (21) (FIG. 5), (22) (FIGS. 2, 3 and 5), having a greater length, are welded directly to the main base (15) (FIGS. 1, 2, 3, 4 and 5). In this second option, the following parts are unnecessary, and therefore, are annulled: swivel mounting (20) (FIGS. 2 and 5), its internal bolt and its base (2) (FIGS. 2 and 5); lock piston (32) (FIG. 7); guide (19) (FIGS. 2 and 5); attaching screw, nut, lock nut and both mixed ball bearings. In this case, it is not necessary using the radio-control unit (74) (FIG. 6), since the lock piston (32) (FIG. 7) does not exist, but it is vital for the subsequent operation of the electromechanical apparatus.

Both options described are feasible, and the choice of using any of them does not alter the functionality of the involved apparatus.

A lever holder (10) (FIGS. 1, 2, and 3) aims to hold the lever (14) (FIGS. 1, 2, 3 and 5), allowing its swinging by means of a bolt (11) (FIGS. 1, 2 and 3), and thus achieving the braking of a brake disc (5) (FIGS. 1 and 5) by braking discs; upper (4) (FIGS. 1 and 5) with a support (3) (FIGS. 1 and 5), and lower (6) (FIGS. 1 and 5) con other support (7) (FIGS. 1 and 5). Thus is threaded on a clamping screw (8) (FIGS. 1 and 5) that is welded in the main base (15) (FIGS. 1, 2, 3, 4 and 5). A screw (12) (FIG. 1) passes through a coupling (53) (FIG. 1), the lever (14) (FIGS. 1, 2, 3 and 5), the main base (15) (FIGS. 1, 2, 3, 4 and 5) and washers (37) (FIG. 1) that rest on the latter, ending threaded on a nut (13) (FIG. 1) and lock nut (52) (FIG. 1). This, in combination with the rigid tube (1) (FIGS. 2, 3, 5, 6 and 7) allows adjustment of the braking of brake disc (5) (FIGS. 1 and 5).

Figure 4:
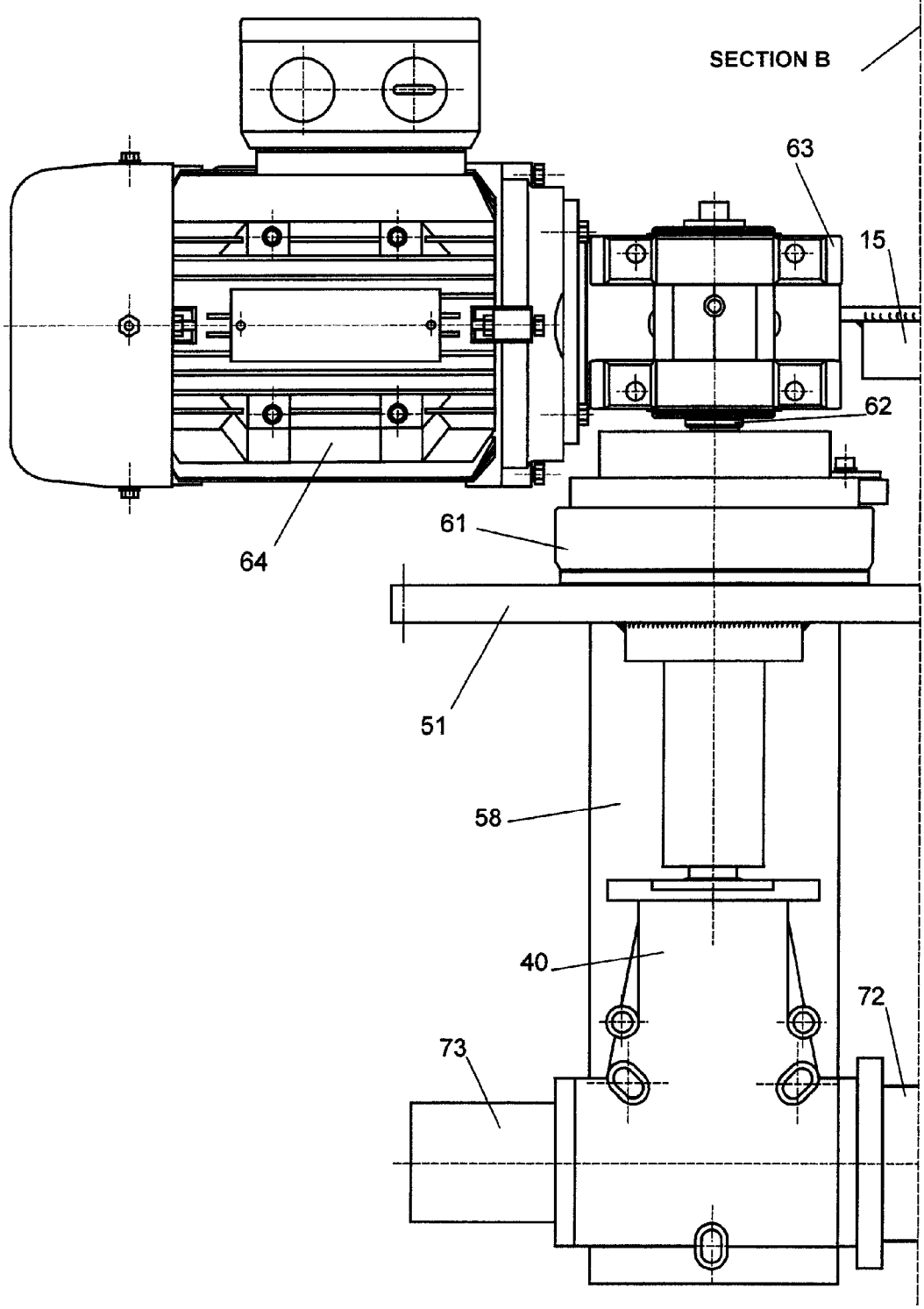
in FIG. 4 can be seen a (left partial) elevation view of the mentioned apparatus.

Welded in the main base (15) (FIGS. 1, 2, 3, 4 and 5) there is a support (58) (FIGS. 1 and 4) holding a motor (64) (FIGS. 1 and 4) with a gearbox (63) which shares a shaft (62) (FIGS. 1 and 4) with a clutch (61) (FIGS. 1 and 4). Below this there is a pinion (51) (FIG. 4) which is engaged with the brake disc (5) (FIGS. 1 and 5), and supported by a diversion (40) (FIGS. 1 and 4) incorporating an encoder (73) (FIG. 4) and a shaft (72) (FIGS. 4 and 5) supporting a reel (9) (FIGS. 1 and 5). This, held by other support (54) (FIGS. 1 and 5) that is welded in the main base (15) (FIGS. 1, 2, 3, 4 and 5), houses a wound mooring cable (36) (FIGS. 2, 3, 5 and 6), which resting on a roller(s) (27) (FIG. 5) with a shaft(s) (24) (FIG. 5), (25) (FIG. 5), (26) (FIG. 5) having a inner stopper (23) (FIG. 5) at the end opposite the tip (28) (2, 3, 6 and 7) of the rigid tube (1) (FIGS. 2, 3, 5, 6 and 7), longitudinally passes through it, ending in a clip hook, where there are secured: the person or people to be evacuated, and a cable with a weight. With all these parts in combination, and complemented with the set of the following: radio-control unit (74) (FIG. 6), uninterruptible power supply system (75) (FIG. 6), batteries (76) (FIG. 6) and electric board (77) (FIG. 6) connected to the mains, the descent and ascent of the mooring cable (36) (FIGS. 2, 3, 5 and 6) is achieved, in order to place it in the desired floor of a building, for the subsequent evacuation of the person or people, in the event of a hypothetical fire or emergency.

There are bolts (30) (FIGS. 2 and 3), (31) (FIGS. 2 and 3), (33) (FIGS. 2 and 3), (34) (FIGS. 2 and 3), with sheaves (35) (FIGS. 2 and 3), retained by terminals (29) (FIGS. 2 and 3), welded to the tip (28) (FIGS. 2, 3, 6 and 7), and allowing the guiding and sliding of the mooring cable (36) (FIGS. 2, 3, 5 and 6).

Welded in the upper part of the main base (15) (FIGS. 1, 2, 3, 4 and 5) there is a support (55) (FIGS. 1 and 5) holding two electric pistons (56) (FIGS. 1 and 5) (57) (FIG. 5) with stoppers (59) (FIGS. 1 and 5) (60) (FIG. 5), allowing, by means of detectors (66) (FIG. 1) (67) (FIGS. 1 and 5), with support (65) (FIGS. 1 and 5) and markers (71) (FIGS. 1 and 5) that the brake disc (5) (FIGS. 1 and 5) has in its perimeter, the total and gradual braking of this, when it rotates at more revolutions than desired. When this occurs, the mentioned piston expand and pass the main base (15) (FIGS. 1, 2, 3, 4 and 5) through holes made, and press springs (41) (FIGS. 1 and 5) (42) (FIG. 5) covered by cases (45) (FIGS. 1 and 5) (46) (FIG. 5) that are resting on the brake disc (5) (FIGS. 1 and 5), and which carry out its braking With all this, and in combination with the aforementioned electric and electronic assembly, the automatic or manual braking (emergency stop or brake) of the brake disc (5) (FIGS. 1 and 5) from the radio-control unit (74) (FIG. 6) is achieved.

The cases (45) (FIGS. 1 and 5) (46) (FIG. 5) has holes where there are located detectors (68) (FIGS. 1 and 5) (69) (FIG. 5) that are held by a regulator (70) (FIGS. 1 and 5) with holder (39) to the main base (15) (FIGS. 1, 2, 3, 4 and 5), and the mission of which is to detect the pass of the stoppers (59) (FIGS. 1 and 5) (60) (FIG. 5) inside said cases (45) (FIGS. 1 and 5) (46) (FIG. 5) in order to verify that the electric pistons (56) (FIGS. 1 and 5) (57) (FIG. 5) work, before making use of the electromechanical apparatus, since otherwise this, for safety, would not work.

When a sudden power outage occurs in the electromechanical apparatus, automatically, springs (43) (FIGS. 1 and 5) (44) (FIG. 5) housed inside cases (47) (FIGS. 1 and 5) (48) (FIG. 5), are pressed by electromagnets (49) (FIGS. 1 and 5) (50) (FIG. 5), which, in combination with the brake disc (5) (FIGS. 1 and 5), achieve the total braking of the latter.

The cabinet that houses the electrical and electronic board (77) (FIG. 6), is connected to the mains, and provides the drawer-support (78) (FIGS. 6 and 7), with power supply, for the power of the uninterruptible power supply system (75) (FIG. 6) with batteries (76) (FIG. 6), of the electromechanical apparatus and a warning light (79) (FIG. 6), which illuminates when there is a failure in the aforementioned apparatus, and therefore warns that it is not operating.

The control of the electromechanical apparatus and its operation, are carried out from a radio-controlled unit (74) (FIG. 6), which has differentiated the following buttons as described below:

"on/emergency stop", the activation of this button, followed by pressing the "reset", achieves the "starting" of the electromechanical apparatus, by the lock piston (32) (FIG. 7) that allows the release of the rigid tube (1) (FIGS. 2, 3, 5, 6 and 7) so that it moves to its operating position. In the case in which the rigid tube (1) (FIGS. 2, 3, 5, 6 and 7) is fixed (second option explained above), the "modus operandi" is the same, i.e., activation of "on/emergency stop", followed by pushing "reset", and the apparatus in question is ready for use.

"down", with the press kept on this button, the mooring cable (36) (FIGS. 2, 3, 5 and 6) descends until the button is released, point at which it stops.

"up", with the press kept on this button, the mooring cable (36) (FIGS. 2, 3, 5 and 6) rises until the button is released, point at which it stops.

"brake", with the press kept on this button, the total braking of the brake disc (5) (FIGS. 1 and 5) is achieved, and therefore, the stop of the mooring cable (36) (FIGS. 2, 3, 5 and 6) and person or people that, secured to this, are coming down. This button is pressed when we appreciate an excessively accelerated descent rate (example: higher than 2 m/sec), but if we release the button, the descent continues.

In the event that in the evacuation, the rate of descent of people is excessively accelerated (example: higher than 2 m/sec), we press "on/emergency stop", and the person or people stop and remain suspended, the apparatus in question and all the buttons of the radio-control unit (74) (FIG. 6) are blocked. For the "starting" of the electromechanical apparatus, we activate "on/emergency stop", and then press "reset". This action performs the unblocking of the aforementioned apparatus and all buttons of the radio-control unit (74) (FIG. 6), and allows the continuation of the descent of the person or people.

The radio-control unit (74) (FIG. 6) has a diode that lights up, simultaneously, with the warning light (79) (FIG. 6) and warns us of a malfunction in any element of the electromechanical apparatus or loss of communication of this with the radio-control unit (74) (FIG. 6), and consequently, for safety reasons, the apparatus in question is not operational.

If the electromechanical apparatus is in operation, and a power failure, either sudden and/or continued, occurs, the behavior and the continuity of operation of the apparatus in question are not affected thanks to the uninterruptible power supply system (75) (FIG. 6).

For the better understanding of what is described above, and the operation of the electromechanical apparatus, the following text is attached by way of example:

When in a hypothetical 20-story building a fire breaks out, for example, on the 8th floor and from the 12th and 15th, there are two people asking for help, we will take the radio-control unit (74) (FIG. 6), and we will start the apparatus in question, by activating "on/emergency stop", and then pressing "reset", all from the perimeter of the building and where we have a good field of view, for the evacuation and the control of the apparatus in question. Then, we will keep hold the button "down", until the mooring cable (36) (FIGS. 2, 3, 5 and 6) is in the desired floor (e.g. 15*a*), point at which we will release the button, and the mooring cable (36) (FIGS. 2, 3, 5 and 6) will stop. The person to be evacuated, with an evacuation harness and mask previously placed, will secure to the mooring cable (FIGS. 2, 3, 5 and 6) by means of a safety clip hook, and then she/he will drop freely by the exterior of the building. Mechanically (and failing that using electrical and electronic aid), she/he will descent to the ground at a moderate speed (approx. 1.5 m/sec. to 2 m/sec.). Once safe, the person disengages the clip hook that attaches her/him to the mooring cable (36) (FIGS. 2, 3, 5 and 6), and from the radio-control unit (74) (FIG. 6) we will keep pressing the "up" button to place again the mooring cable (36) (FIGS. 2, 3, 5 and 6), in the desired floor (12*a*), point at which we will release the button and this will stop, to facilitate the next engagement and evacuation. At this point, we repeat the "modus operandi" as many times as necessary.

If during the descent in the evacuation fails: the power supply, uninterruptible power supply system (75), electric pistons (56 and 57), detectors (66 and 67), or radio-control unit, with the consequent loss of communication, the electromagnets (49 and 50) are activated automatically for safety, and they brake and stop the descent of the person or people, leaving them suspended.

All the above, in combination, allows and provides the electromechanical apparatus intended to evacuate buildings in the event of a fire, with the autonomy, capacity and security, sufficient and necessary, for the rescue of people, from any height of a building, in the event of fire, or any type of emergency.

Having described the nature and the functional scope of the invention as well as a preferred form of putting it into practice, it is hereby stated that therein, the materials used for manufacturing of components of the electromechanical apparatus, parts, shapes, dimensions and colors thereof, and generally all the details and those accessory or secondary features, that may have, provided, they do not alter, change, modify or affect its essentiality, can be independent and varied.

The invention claimed is:

1. An electromechanical apparatus for saving a person from a fire in a building, the electromechanical apparatus comprising:

a main base that supports a base therefrom;

a swivel mounting hanging from said base, said swivel mount having a pair of ears having a holes positioned in alignment with each other;

a retaining ring having a rigid tube welded thereto, said retaining ring being supported by said swivel mounting, said retaining ring and said swivel mounting receiving a bolt extending through said holes of said swivel mounting;

a bush resting on a guide, said bush cooperative with said rigid tube so as to cause said rigid tube to rotate 90° and to cause said rigid tube to obtain an exact orientation;

a radio control unit cooperative with said bush so as to allow a descent of the person from the building;

a lever affixed to said main base by a holder, said lever supported at one end thereof by said bush, said lever having an upper braking disc supported therefrom, said upper braking disc in contact with a brake disc, said brake disc having markers thereon, said brake disc resting on a lower braking disc, said lower braking disc having a support threaded in a clamping screw, said clamping screw welded to a lower portion of said main base, said lever swinging so as to transmit a force applied to said rigid tube caused by the weight of the descending person to said upper braking disc and the brake disc and the lower braking disc;

a gear box coupled to a shaft of a motor, said shaft passing through a clutch, said gear box cooperative with said brake disc by a pinion, said pinion coupled to a diversion, said diversion having a shaft that supports a reel thereon; and a piston support affixed to an upper part of said main base, said piston support holding electric pistons and electromagnets which contact springs that support said upper braking discs.

2. The electromechanical apparatus of claim 1, further comprising:

a detector secured by a detector holder that is welded onto a lower portion of said main base.

3. The electromechanical apparatus of claim 2, further comprising:

a regulator holder affixed to said main base and which supports a regulator, said regulator cooperative with said detector.

4. The electromechanical apparatus of claim 1, said radio control unit being in communication with an interruptible power supply.

* * * * *